US007351104B2

(12) United States Patent
Neer et al.

(10) Patent No.: US 7,351,104 B2
(45) Date of Patent: Apr. 1, 2008

(54) KEYED HOUSING FOR USE WITH SMALL SIZE PLUG CONNECTORS

(75) Inventors: Jay H. Neer, Boca Raton, FL (US); Brian Keith Lloyd, Maumelle, AR (US); Cleaver Brinkerhoff, Park Ridge, IL (US); Philip J. Dambach, Naperville, IL (US); Deborah Kiley, St. Charles, IL (US); Bruce Reed, Maumelle, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/176,483

(22) Filed: Jul. 7, 2005

(65) Prior Publication Data

US 2006/0040556 A1 Feb. 23, 2006

Related U.S. Application Data

(60) Provisional application No. 60/585,780, filed on Jul. 7, 2004.

(51) Int. Cl.
*H01R 13/648* (2006.01)

(52) U.S. Cl. ..... 439/607

(58) Field of Classification Search ..... 439/607, 439/608, 609, 680, 681
See application file for complete search history.

(56) References Cited

U.S. PATENT DOCUMENTS

| | | | | |
|---|---|---|---|---|
| 4,386,814 | A * | 6/1983 | Asick | 439/607 |
| 5,190,479 | A * | 3/1993 | Jordi | 439/620 |
| 5,445,534 | A | 8/1995 | Ishizuka et al. | |
| 6,296,514 | B1 | 10/2001 | Medina et al. | |
| 6,315,608 | B1 * | 11/2001 | Lopata et al. | 439/607 |
| 6,358,089 | B1 * | 3/2002 | Kuroda et al. | 439/607 |
| 6,663,425 | B1 | 12/2003 | Zhang et al. | |
| 6,746,282 | B2 * | 6/2004 | Meister | 439/638 |
| 6,824,969 | B1 * | 11/2004 | Ko | 439/680 |
| 6,863,546 | B2 | 3/2005 | Yang et al. | |
| 6,939,177 | B2 * | 9/2005 | Kato et al. | 439/638 |
| 7,025,617 | B2 | 4/2006 | Regnier et al. | |
| 7,048,567 | B2 | 5/2006 | Regnier et al. | |
| 2006/0009080 | A1 | 1/2006 | Regnier et al. | |
| 2006/0014438 | A1 | 1/2006 | Regnier et al. | |
| 2006/0019525 | A1 | 1/2006 | Lloyd et al. | |
| 2006/0160429 | A1 | 7/2006 | Dawiedczyk et al. | |
| 2006/0189180 | A1 | 8/2006 | Lang et al. | |

FOREIGN PATENT DOCUMENTS

| | | |
|---|---|---|
| EP | 0 595 304 | 5/1994 |
| EP | 0-792 206 | 8/1996 |
| WO | WO 02/101883 | 12/2002 |
| WO | WO 03/098752 | 11/2003 |

* cited by examiner

OTHER PUBLICATIONS

International Search Report of copending International Patent Application No. PCT/US2005/024096, Oct. 17, 2005.

*Primary Examiner*—Phuong Dinh
(74) *Attorney, Agent, or Firm*—Thomas D. Paulius

(57) ABSTRACT

A shielded housing that provides a shield to a circuit board connector of the SFP-style includes a conductive body that encompasses the connector. The housing has an opening that defines an entrance of the housing through which an opposing mating connector may be inserted. The housing entrance includes one or more guide members that extend into the center of the housing and provide a guide for guiding an opposing mating connector into engagement with the circuit board connector.

9 Claims, 14 Drawing Sheets

FIG. 10A
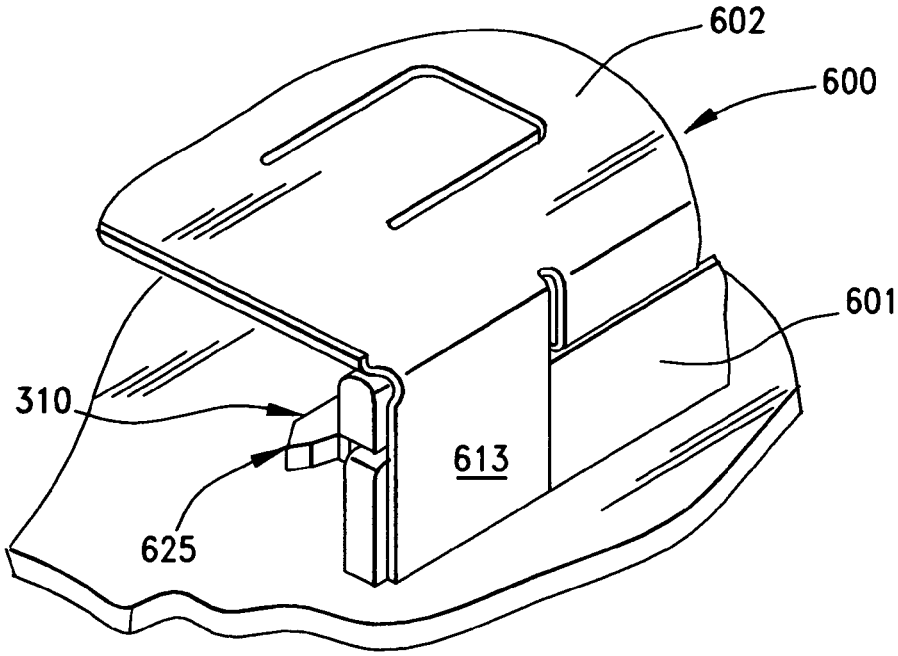
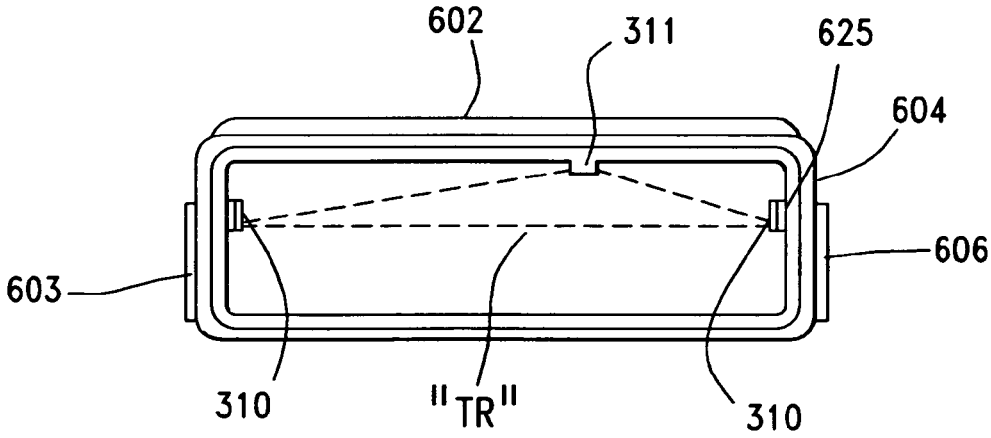
FIG. 10B

KEYED HOUSING FOR USE WITH SMALL SIZE PLUG CONNECTORS

REFERENCE TO RELATED APPLICATIONS

This application claims priority of prior U.S. Provisional Patent Application No. 60/585,780, filed Jul. 7, 2004.

BACKGROUND OF THE INVENTION

The present invention is directed generally to small size connectors and, more particularly to shielded housings that enclose such connectors.

High speed data transfer systems require electrical connectors in which the electrical impedance can be controlled in order to maintain the required data transfer rate of the electrical system. Low profile connectors, such as those used in SFP (Small Form Factor Pluggable) applications are desired in electronic devices in which space is at a premium and thus it is difficult to guide the opposing mating plug connectors into contact with such connectors. The plug connector typically includes a circuit card that has a projecting edge that is received within a card opening in the SFP connector. Shielding cages are typically utilized with such connectors to control the emission of electromagnetic interference. These cages often serve as a secondary housing for the connector in that they will substantially enclose the connectors. The small size of the SFP style connectors makes it difficult for ensuring that the opposing mating connectors mate properly with the SFP connectors, especially in a blind mating application.

It is further difficult with these small sizes to ensure that the shield housing is of a size sufficiently large to permit solder reflow processing of the connector without bridging occurring between the connector contacts and the shield housing.

The present invention is directed to an improved housing for use with SFP connectors of reduced size that overcomes the aforementioned shortcomings and which provides a means for guiding the opposing mating connector into the housing and into engagement with the SFP connector.

SUMMARY OF THE INVENTION

Accordingly, it is a general object of the present invention to provide a surface mount style connector for mounting on a circuit board, the connector having a plurality of conductive terminals supported therein in spaced apart order, and a conductive outer shielding cage or housing that encompasses the connector and controls electromagnetic interference emission therefrom.

A further object of the present invention is to provide a shielded housing for use with a right angle, low profile surface mount connector in high speed applications in which the shielded housing has one or more guides formed therewith which extend into an interior space of the shielded housing and which are received within corresponding opposing recesses formed in the opposing mating connector.

A still further object of the present invention is to provide a shield housing for use with a surface mount connector that guides an opposing connector into place with the connector and which may be manufactured inexpensively with a reduced size so as not to enlarge the size of the overall connector system it is used with.

Another object of the present invention is to provide a shield housing for use with SFP-style connectors in which the shield housing includes a diecast hollow base and a sheet metal cover member, the cover member having an entrance portion associated that engages a forward portion of the base, the base including two sidewalls spaced apart from each other and extending rearwardly from the entrance portion, each of the sidewalls including at least one guide rail projecting therefrom, the guide rails being received within corresponding recesses formed on the opposing mating connector and collectively cooperating to guide the opposing mating connector into engagement with the SFP connector enclosed by the shield housing.

Still yet another object of the present invention is to provide a shielded housing with a connector guide system incorporated therein with multiple points of engagement that assist in keying of an opposing connector and blind mating of an opposing connector with the housing, and which the housing having a shape that permits multiple ones of such housings to be spaced close to each other.

The present invention accomplishes the aforementioned and other objects by the way of its structure. In one embodiment of the invention, a conductive metal housing is formed such as by die casting and the housing includes an interior hollow portion. This hollow portion fits around a SFP-style connector that is mounted to a circuit board. The housing has an opening formed at a forward portion thereof and the opening defines an entrance to the housing. One or more projections are formed with the housing and these projections extend inwardly into the recess and into the opening of the housing to provide one or more guide members that are received within corresponding recesses, or grooves, formed in the exterior of the opposing mating connector.

In another embodiment of the present invention, the housing may be formed of multiple pieces. In this embodiment, a hollow, open base is provided that includes at least a pair of spaced-apart side walls, each of which has a guide projection formed on an interior surface thereof. These two guides must be received within corresponding opposing grooves formed in an opposing mating connector in order for the opposing mating connector to fit into and enter the housing to mate with the SFP style connector. As such they define a keying system that ensures correct mating of the two connectors, even when the installation of the opposing mating connector is blind. The housing may further include a sheet metal cover with a rectangular, hollow entrance portion that is formed so as to mate with the forward end of the base. In order to provide a measure of "keying" to the opposing connector, the cover for the housing may be provided with a rail or projection or a series of tabs formed therewith that also extend inwardly of the housing and which are received within corresponding opposing slots or recesses in the mating connector.

In another embodiment of the invention, the shield housing may be entirely formed from a sheet metal and is constructed by way of a stamping and forming process. One or more tabs are stamped out of the sheet metal and are bent downwardly in a line so as to enter the interior of the housing. These tabs must be received within a corresponding opposing recess, or groove, on the mating connector in order for the connector to be properly received within the shield housing. These tabs are preferably utilized with guide members formed in the side wall of the housing to provide a three-point means of engagement for blind mating and polarizing the insertion of an opposing mating connector.

In yet another embodiment of the invention, the housing may be formed as a one-piece or two-piece die cast housing with means for attaching it to a circuit board such as by way of screws of the like. The housing preferably includes a series of posts that have mounting holes drilled therein which receive mounting screws, and the posts are arranged in a staggered fashion along the sidewalls of the housing so that the posts on the left side of a housing may fit into grooves that are formed on the right side of an adjacent housing between similar posts. This staggering permits the housings to be placed in a close, adjacent spacing with each other on circuit boards, and also aligns the housing so that they may be arranged in a belly to belly fashion on a circuit board.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 10A is an enlarged detail view of a portion of the housing of FIG. 10, illustrating the extent to which one of the guide members of the housing projects out past the front edge of the housing;

FIG. 10B is a front end view of an alternate construction of a shielded housing similar to that illustrated in FIG. 10;

DETAILED DESCRIPTION OF THE PREFERRED EMBODIMENTS

Figure 1:
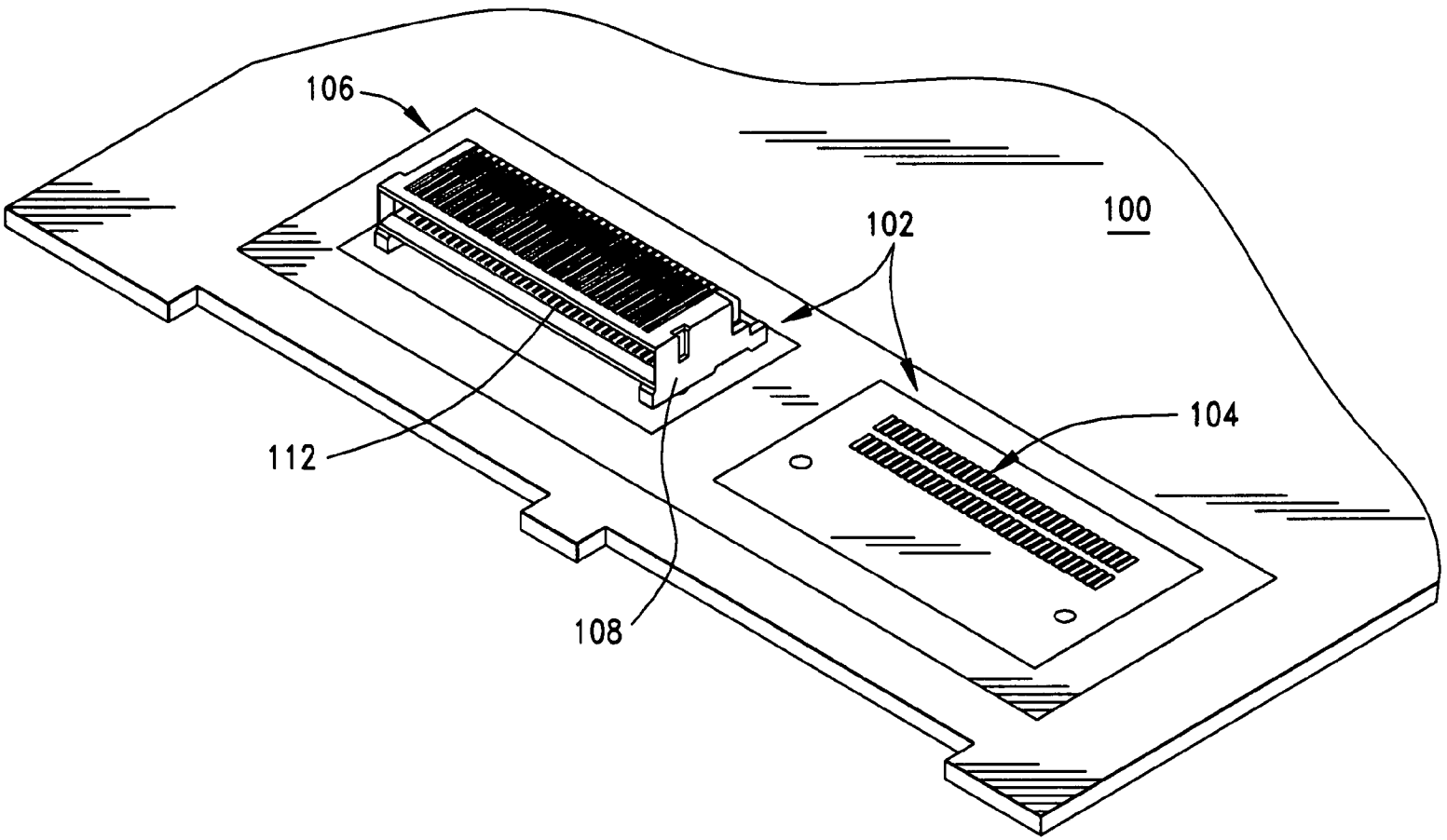
FIG. 1 is a perspective view of a circuit board with two arrangements of conductive contact pads disposed thereon and with a SFP-style connector mounted to one of the two contact pad arrangements.
Figure 6:
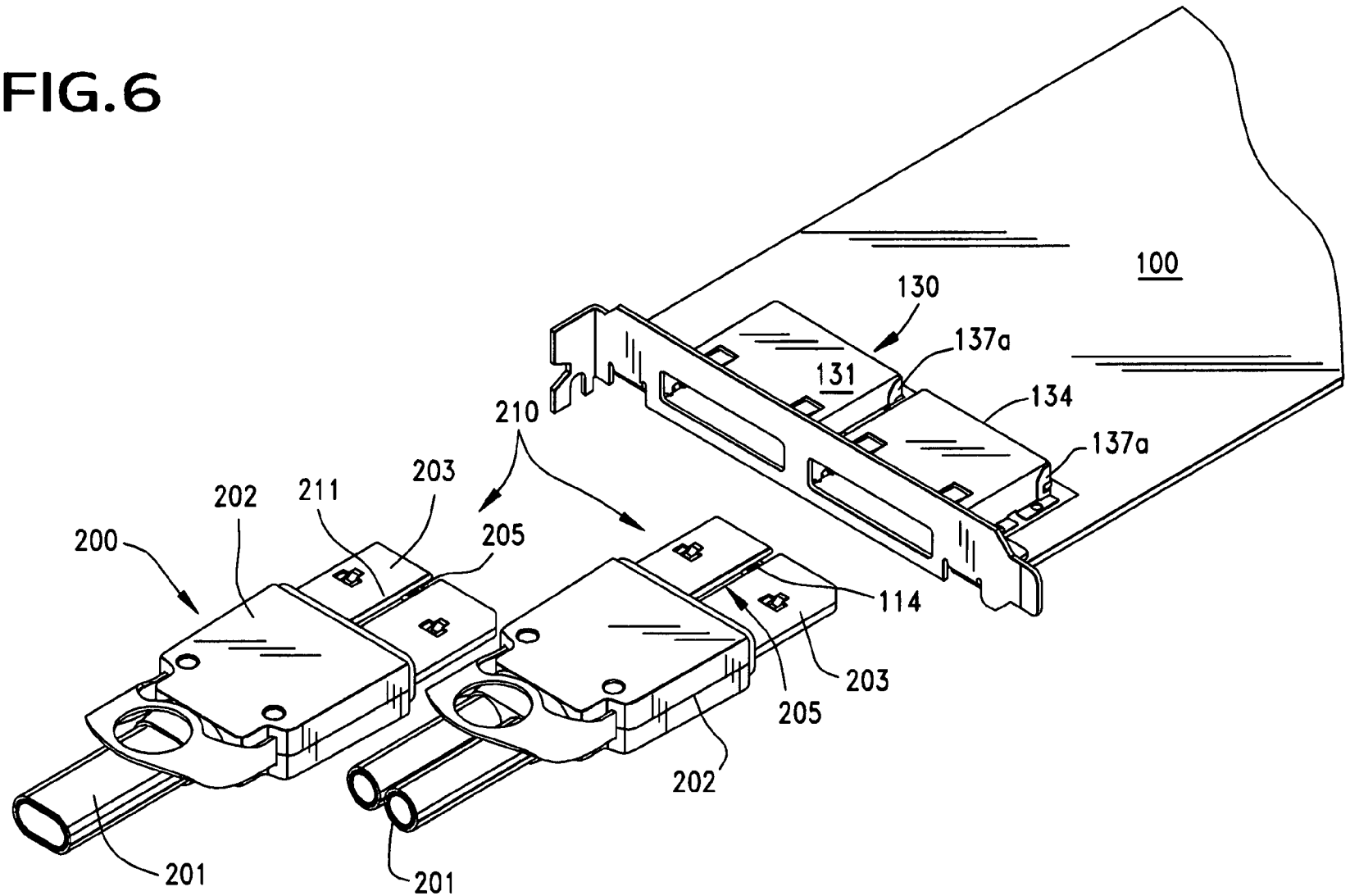
FIG. 6 is a the same view as FIG. 5, but with a mounting bracket in place across the two shield housings and with two opposing mating plug connectors shown removed from engagement with the SFP-style connectors.

FIG. 1 illustrates the environment in which the shielded housings of the invention are used. The environment shown includes a planar circuit board 100, with two designated connector areas 102 defined therein, each including a plurality of conductive contact pads 104. One such area has a SFP-style connector 106 in place. This connector 106 has an insulative housing 108 and supports a plurality of conductive terminals 110. Such a connector 106 typically includes a slot 112 that is intended to receive the edge of a circuit card 114 (FIG. 6) that is mounted to an opposing mating plug-style connector 200. (FIG. 6.)

Figure 2:
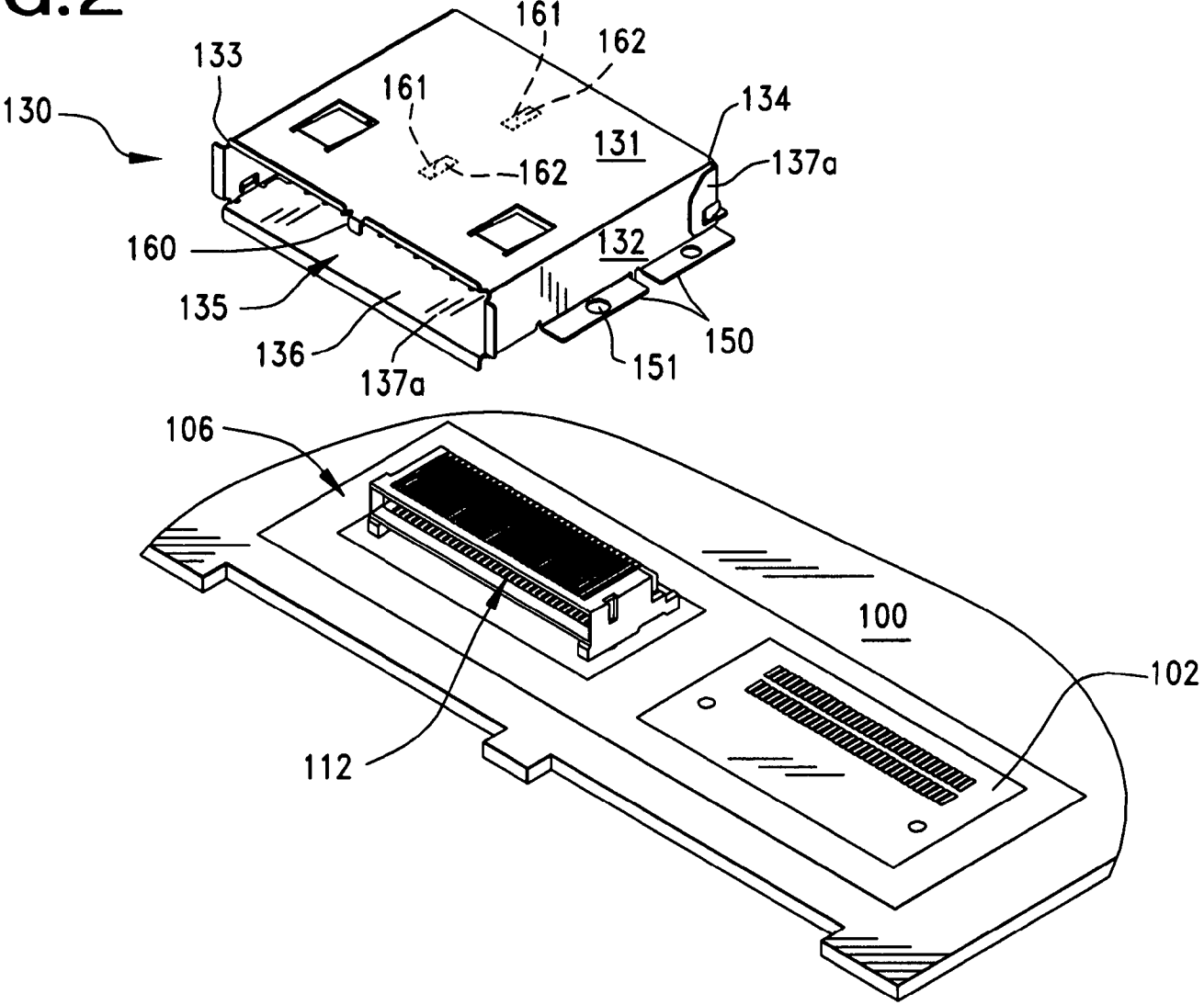
FIG. 2 is a the same view as FIG. 1, but with a shield housing constructed in accordance with the principles of the present invention shown removed away from and above the circuit board.

FIG. 2 illustrates one embodiment of a shield housing 130 constructed in accordance with the principles of the present invention. As illustrated, the shield housing 130, is preferably formed from a sheet metal blank through a suitable process, such as a stamping and forming process. In this regard, it includes a top wall 131, two side walls 132, 133, a back wall 134 and a bottom wall 135. These walls are all combined to collectively define a bottom opening 139 that leads to a hollow interior cavity 137, while the top wall, two side walls and bottom wall cooperate to define an entrance, or opening 136 that also leads to the hollow interior cavity 137. The back wall 134 may include a pair of flange ends 137*a*, which are bent over upon the rear ends of each side wall 132, 133 to secure the back wall to the housing and to seal off the rear of the internal cavity 137. The bottom wall 135 is preferably formed as only a partial extent that does not extend completely back to the rear wall 134. Rather, it has a depth that is less than the depth of the entire housing to define an opening 139 on the bottom of the housing 130 which may be placed over the SFP-style connector 106 with which it is used. The bottom wall 135 may have an engagement flange 140 formed at an end thereof, which is bent at an angle and which engages a corresponding opposing engagement tab 141 formed on side wall 133 to secure a framework for the entrance of the shield housing 130

Figure 3:
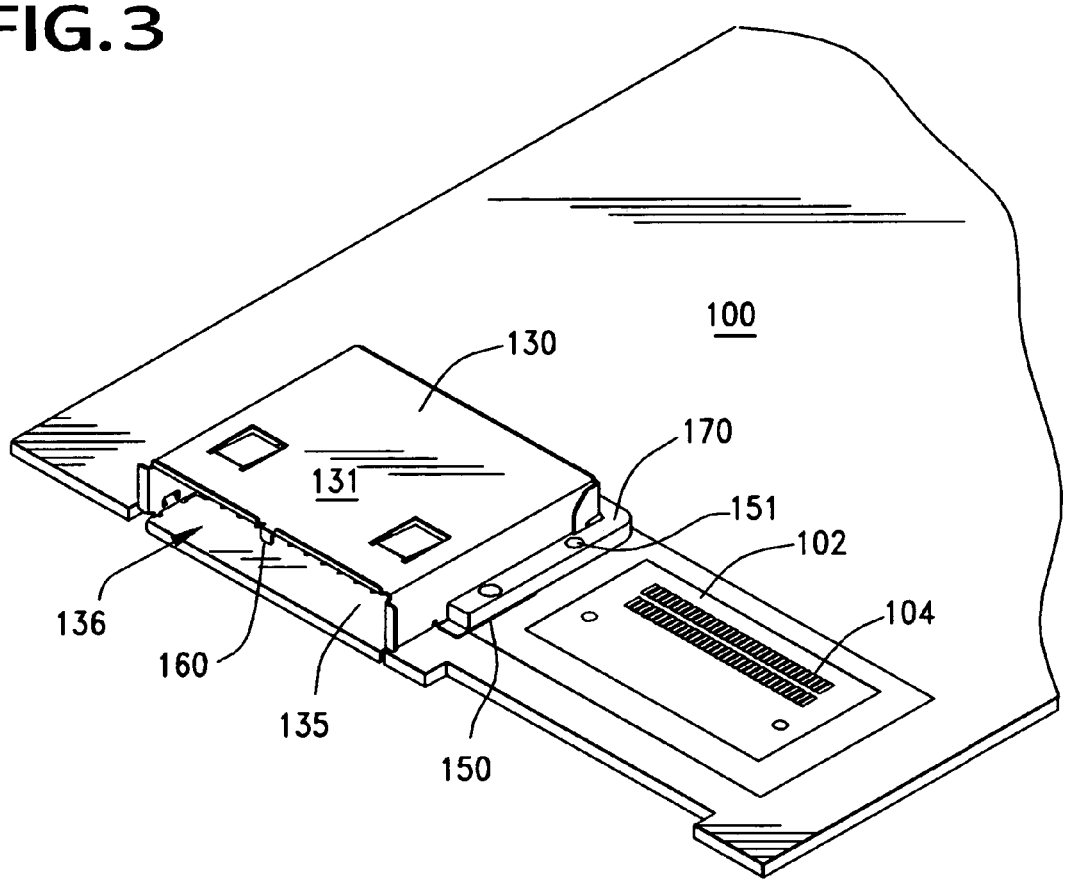
FIG. 3 is a same view as FIG. 2, but with the shield housing shown in place upon the circuit board and encompassing the SFP-style connector.
Figure 4:
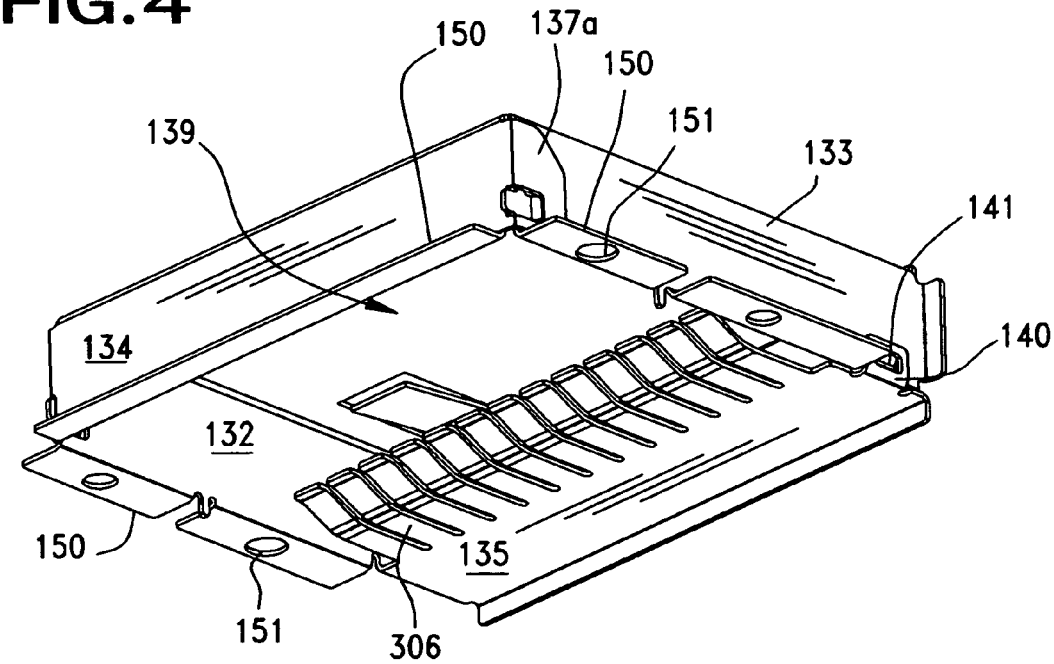
FIG. 4 is a perspective view, taken from underneath, of the shield housing of FIGS. 2 & 3.
Figure 5:
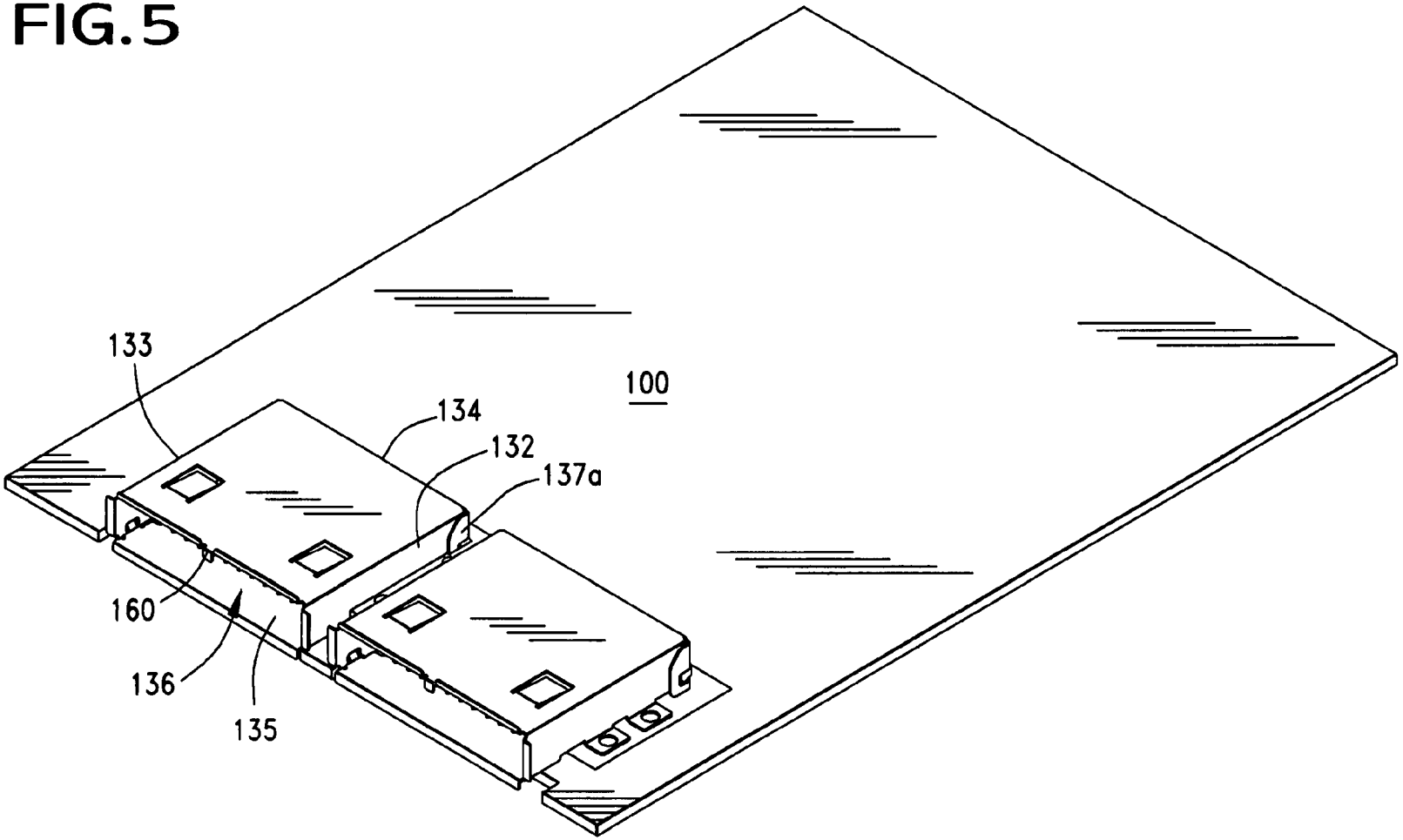
FIG. 5 is the same view as FIG. 4, but with a second shield housing mounted adjacent to the first shield housing.

As shown best in FIGS. 1 & 4, the housing 130 may also include a series of flanges 150 formed along the side walls 132, 133 or back wall 134 that are bent at an angle in order to provide a flat mounting surface that opposes the top surface of the circuit board 100. These flanges 150 may include openings 151 that receive screws or bolts (not shown) for attachment to the circuit board or they may be flat for soldering to the board 100. A U-shaped EMI gasket 170 may be placed over these flanges 150 as shown in FIG. 3 to prevent EMI leakage from the sides and rear of the housing 103.

Turning to FIG. 2, in an important aspect of the present invention, the housing 130 includes means for guiding the opposing mating connector 200 into the internal cavity 137 of the housing 130. This guide means may also be referred to as a "keying" means because it wil permit an opposing mating plug connector to be inserted into the shield housing 130 in only one orientation, and such a means is illustrated in the first embodiment as a guide tab 160 that is formed along the front edge of the housing entrance 136. Although only one such guide tab 160 is illustrated, it will be understood that additional guide tabs 162 that are shown in phantom in FIG. 2 may be formed in the top wall 131 of the housing 130. Such tabs 162 may be formed by making a U-shaped opening 161 in the top wall 131 to define the edges of the guide tab 162, and subsequently bending the guide tabs 162 down into the internal cavity 137 of the housing 130. Other suitable means may also be used to form the tabs. The guide tab 160 (or tabs 162) define a positioning point for the opposing mating connector 200. The tabs 160, 162 are preferably aligned along an imaginary line that extends toward the rear of the housing 130.

Figure 7:
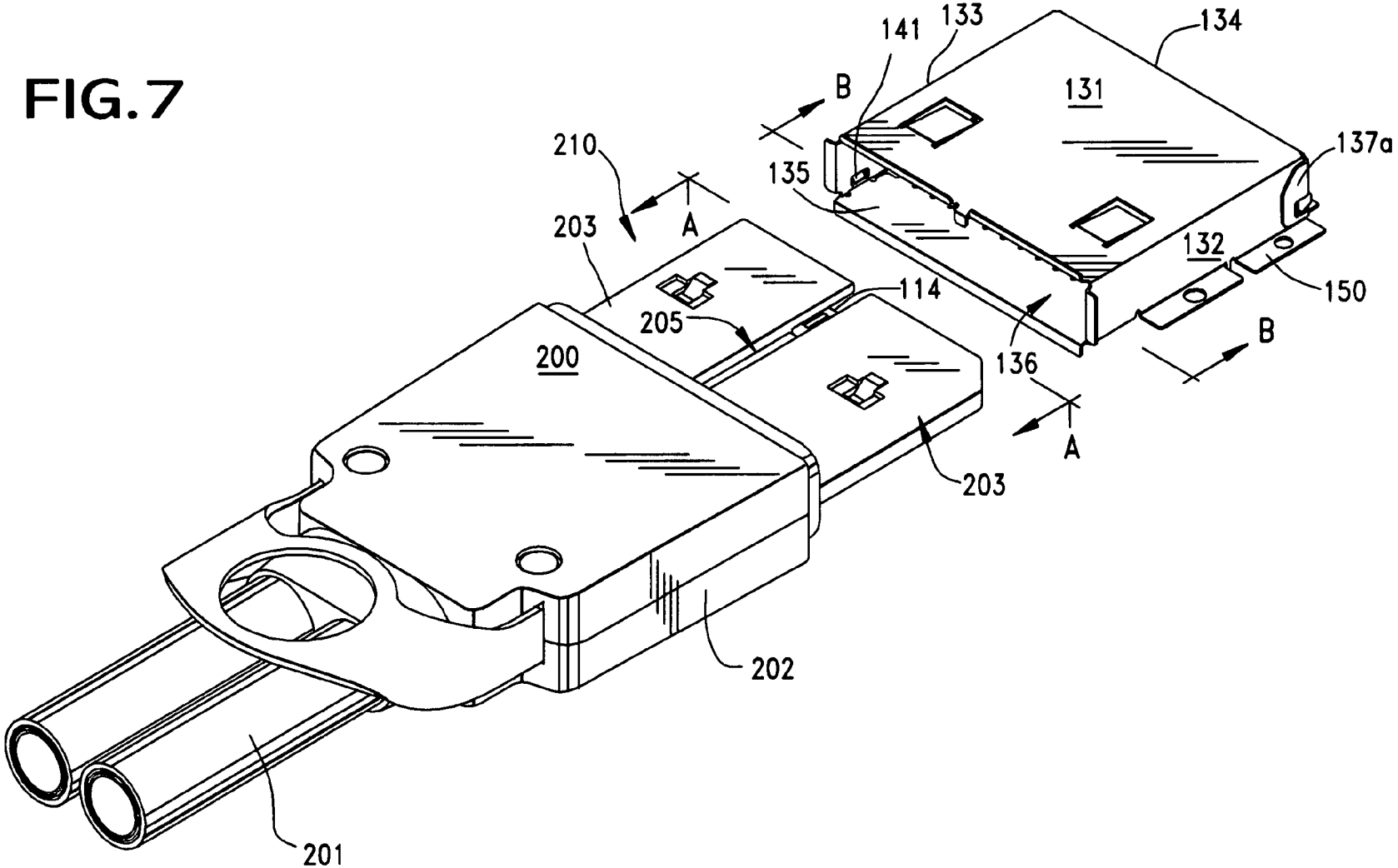
FIG. 7 is an enlarged perspective view of the connector housing of FIG. 4 and an opposing mating connector of FIG. 6 shown in alignment with each other.
Figure 7A:
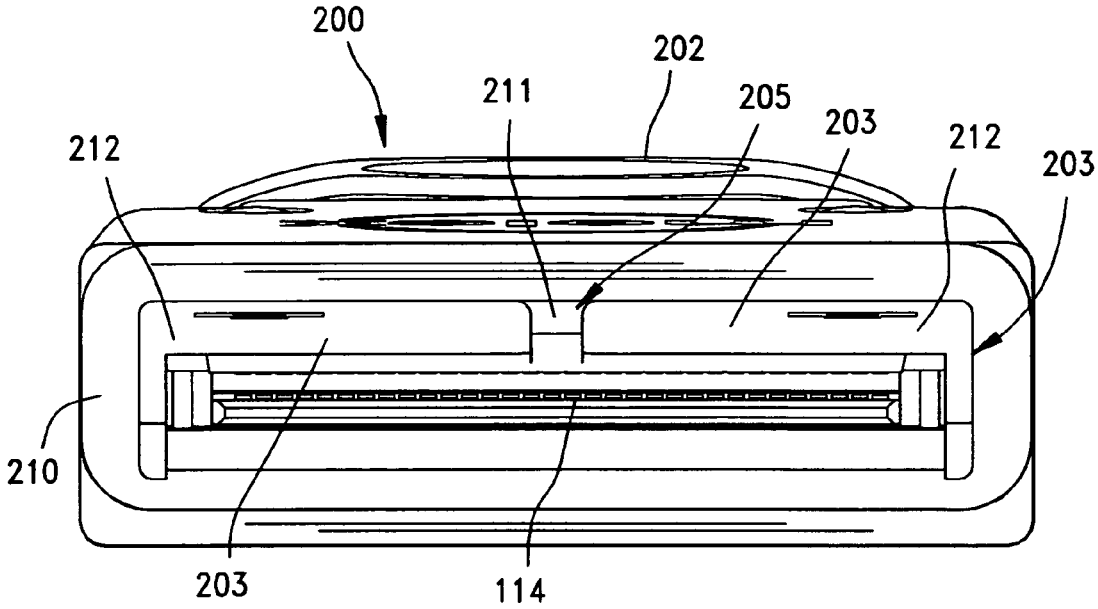
FIG. 7A is an elevational view of the front end of the opposing mating connector, taken along lines A-A of FIG. 7.
Figure 7B:
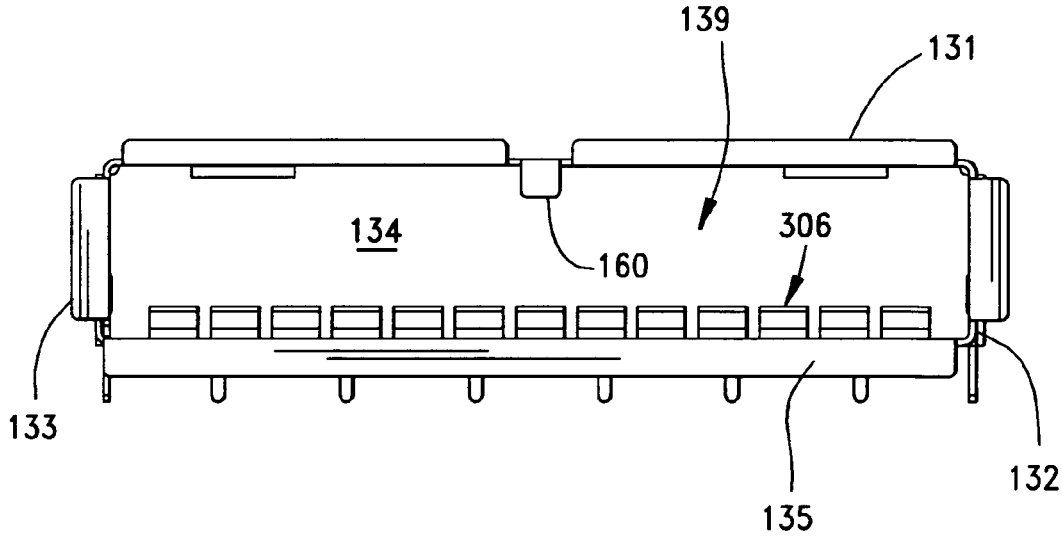
FIG. 7B is an elevational view of the front end of the shield housing of the invention, taken along lines B-B of FIG. 7 and with the shield housing removed from a circuit board and with the interior SFP-style connector removed for clarity.

An opposing mating plug-style connector 200 is illustrated in FIG. 6 and it can be seen that the plug connector includes a housing 202 attached to one or more electrical cables 201, each of which preferably includes a plurality of wires (not shown) that are intended to connect with circuits of the circuit board 100. The connector 200 may include one or more male projecting portions in the form of circuit cards 114 that are received within the circuit card slot 112 of the board connector 106. These projecting portions, as well as the rest of the front end 210 of the connector 200 are encompassed by a conductive shield 203, both such structures defining the mating portion of the plug connector 200. The shield 203 includes a guide slot 205, which as illustrated, may be formed as a slot 211 that separates the top portion of the shield 203 into two separate parts 212 (FIG. 7A). It may also be formed as a recess, or channel, in the top portion of the plug connector shield 203, in which case, the top portion of the plug connector mating portion will not be divided into two separate portions. This guide slot 205, as shown in FIGS. 6 & 7, preferably extends the length of the front mating portion of the plug connector 200.

Alternatively, the entire shield housing 130 may be integrally formed as a single die cast piece, with the guide tabs 160, 162 formed as part of the casting process, rather than being stamped from the top portion of the housing 130. In such an embodiment, the guide tabs may extend for the entire depth of the connector, and in place of guide tabs, a continuous guide member such as a rail may be utilized, as is shown on the sidewalls of the housing in FIG. 8.

Figure 8:
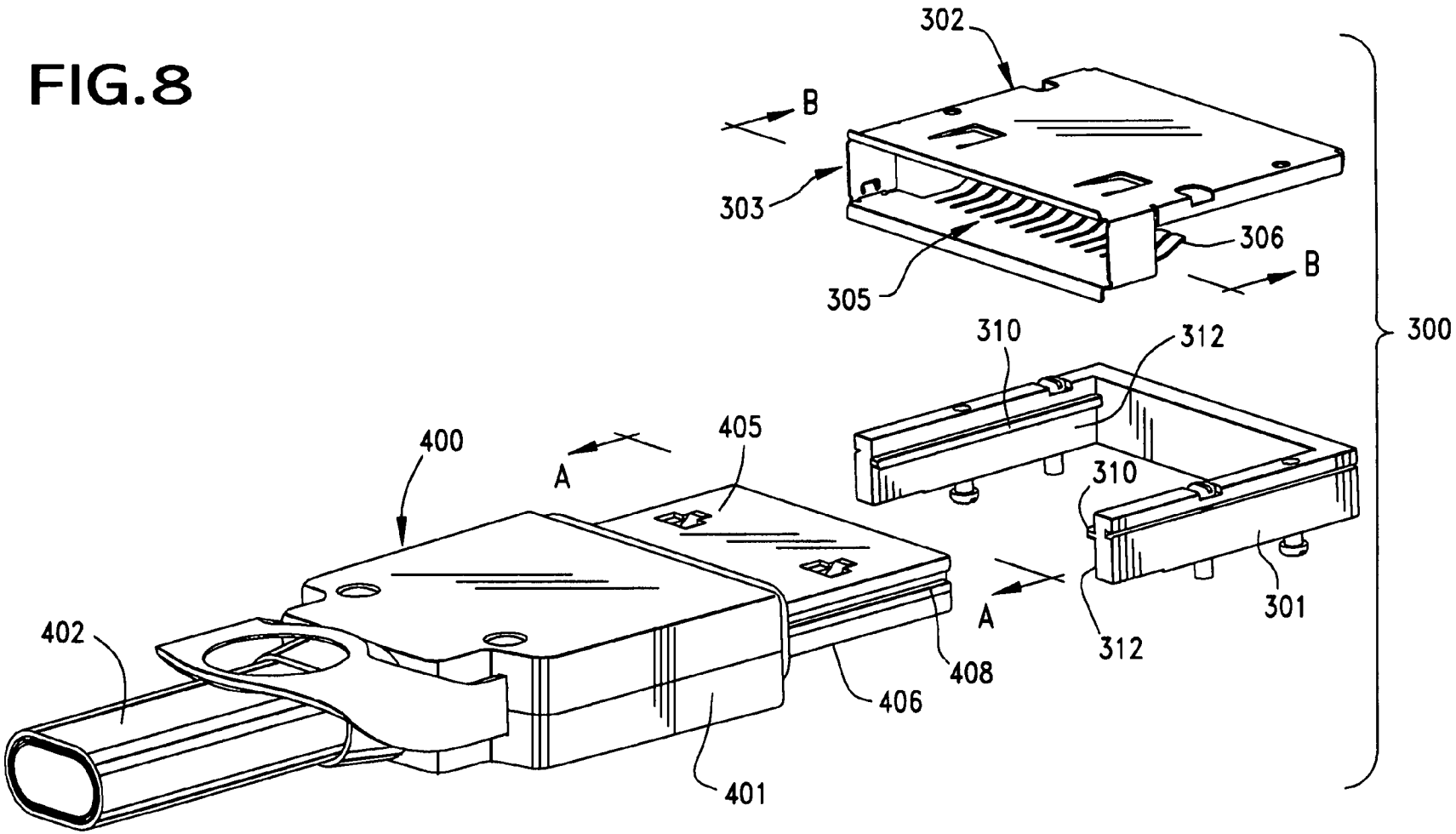
FIG. 8 is an exploded perspective view of another embodiment of a shield housing and mating connector assembly constructed in accordance with the principles of the present invention.
Figure 8A:
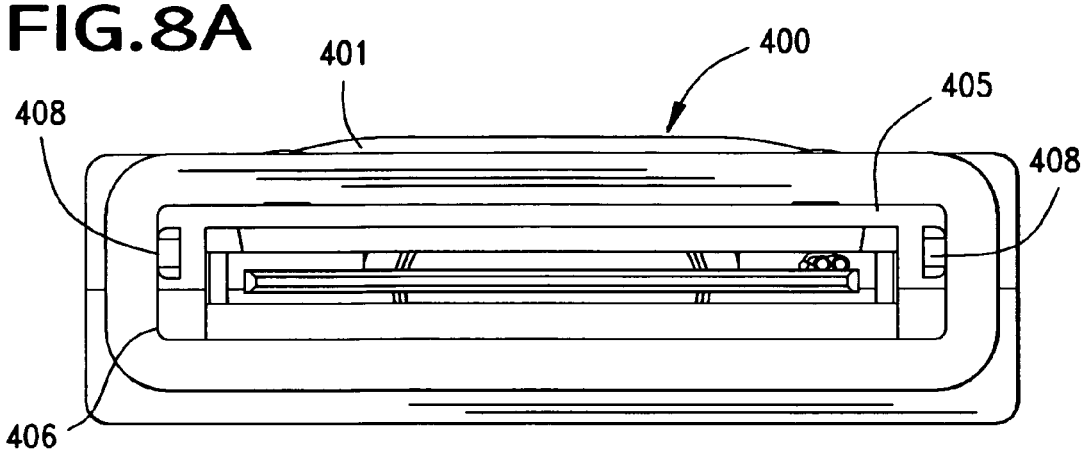
FIG. 8A is an elevational view of the front end of the opposing mating connector, taken along lines A-A of FIG. 8.
Figure 8B:
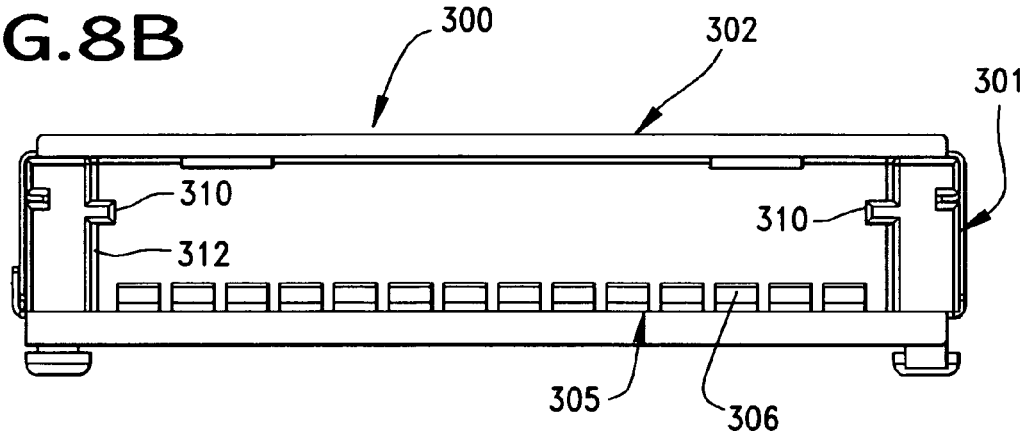
FIG. 8B is an elevational view of the front end of the shield housing of the invention, taken along lines B-B of FIG. 8 and with the shield housing removed from a circuit board and with the interior SFP-style connector removed for clarity.

FIGS. 8-8B illustrate another embodiment of a shield housing incorporating the principles of the present invention. In this embodiment, the shield housing 300 is formed from multiple pieces including a base portion 301 that is preferably die cast and a cover portion 302 that is preferably stamped and formed from sheet metal. The cover portion 302, as illustrated, includes an entrance portion 303 formed in a manner similar to the entrance 136 of the shield housing 130 described above. This cover portion 302, like the shield housing 130 also includes an EMI gasket 305 incorporated therein, which takes the form of a metal strip that is slotted to provide a plurality of conductive spring fingers 306 that rise up into the internal cavity of the housing 130, 300 in order to contact a conductive bottom surface of the opposing connector, 200, 400.

The base portion 301 shown in FIG. 8 includes a pair of elongated guide rails 310 that are formed on the interior surfaces 312 thereof. These rails 310 provide a means for guiding the connector 400 into place within the internal cavity of the housing 300. The opposing connector 400 includes a housing 401 that is attached to a cable 402 and a conductive shield 405 that extends forwardly of the connector housing 401. The shield 405 has grooves 408 formed in its side walls 406 that mate with the guide rails 310 of the housing base side walls. FIGS. 8A & 8B are front elevational views of the plug connector 400 and the shield housing 300, respectively, which illustrate their associated guide rails 310 and the grooves 408.

Figure 9:
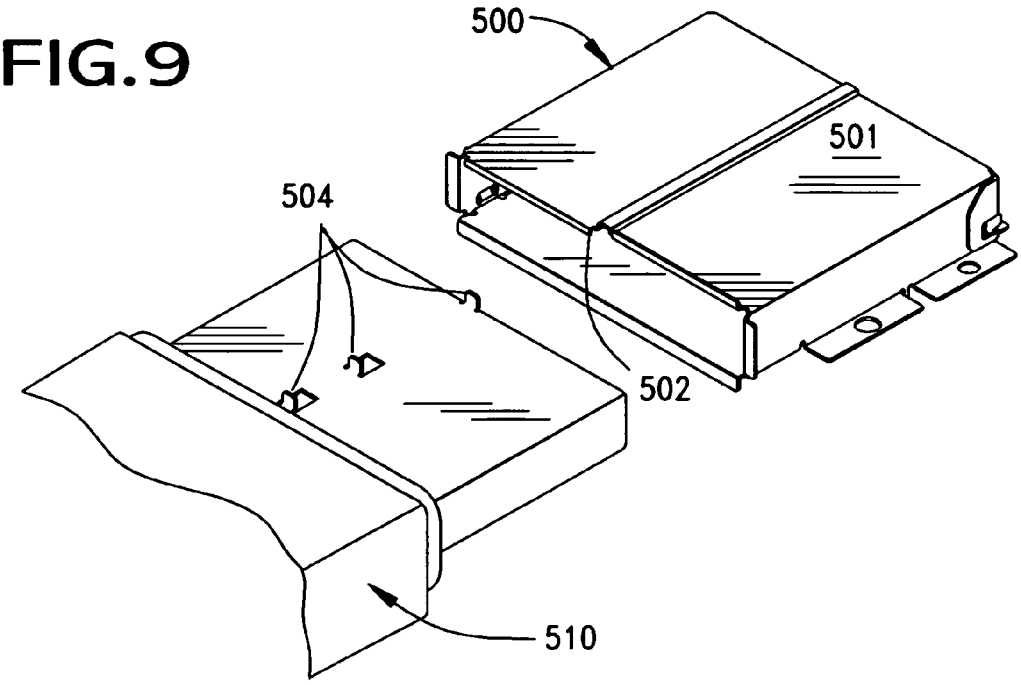
FIG. 9 is a view illustrating another embodiment of a guide mechanism incorporating the principles of the present invention.

FIG. 9 illustrates another embodiment of a shielded housing 500 in which the top wall 501 of the housing 500 includes a groove 502 formed therein which extend for the depth of the housing top wall 501. A corresponding opposing connector 510 is provided with one or more guide tabs, or other projections 504 formed in a shield portion 505 of the connector 510 and which are aligned so as to mate with the shielded housing groove 502. This illustrates a keying means that uses a positive projection on the mating portion of the plug connector, rather than the groove or slot described above. The groove 502 extends away from the hollow interior portion of the housing 500, rather than into it as with the other embodiments. Although illustrated as a series of tabs, the projections 504 may be formed as a single, continuous element that extends lengthwise of the plug connector.

Figure 10:
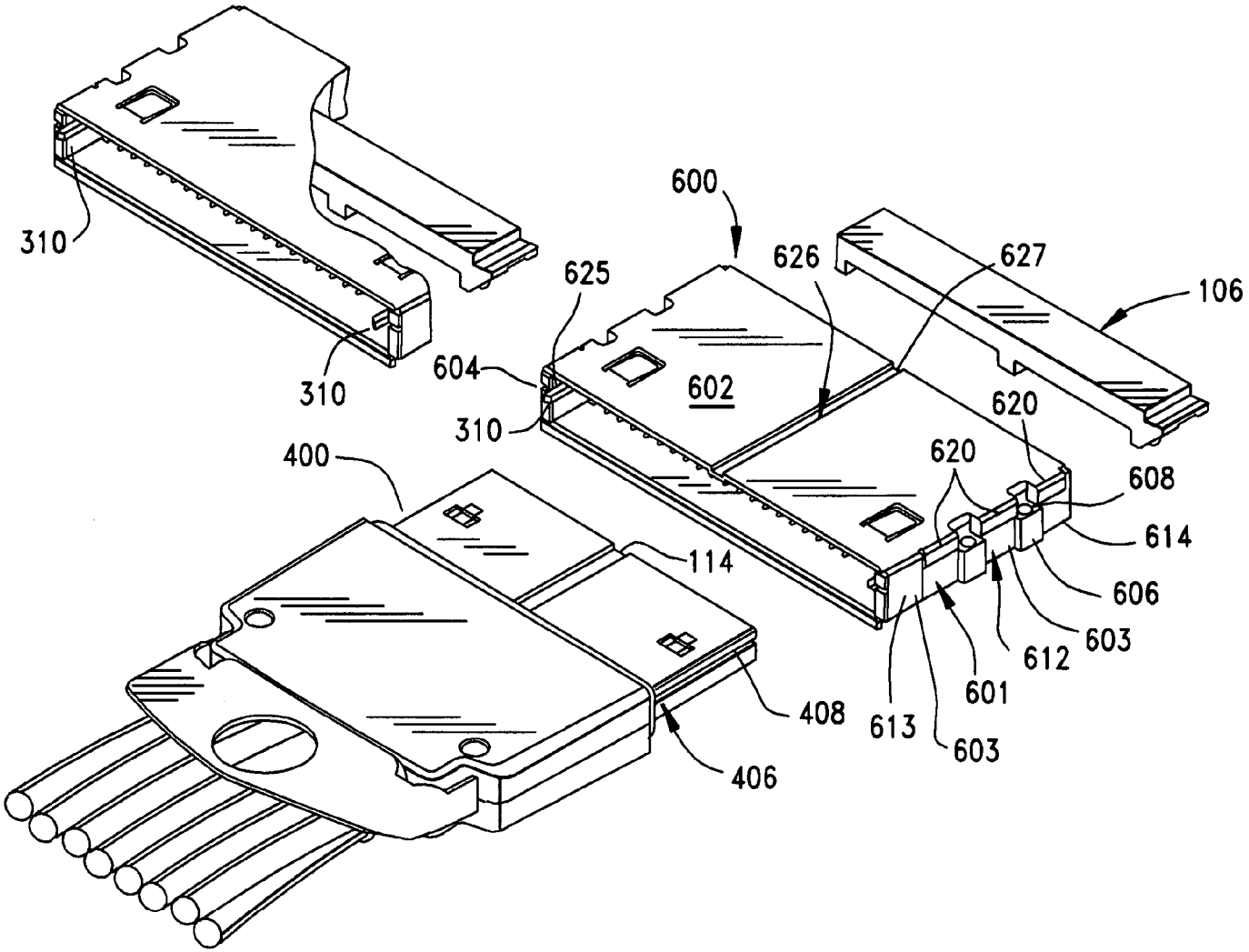
FIG. 10 is an exploded view of another embodiment of a shielded housing assembly incorporating the principles of the present invention.

FIG. 10 illustrates yet another embodiment of a shielded housing 600 constructed in accordance with the principles of the present invention and which is preferably die cast from a conductive material. The housing 600 includes a base 601 and a sheet metal top cover portion 602 as described above. The base portion 601 includes side walls 603, 604 and each of the side walls 603, 604 includes one or more attachment posts 606 that have screw or bolt holes 608 formed therein into which a bolt or screw may be inserted in order to hold the housing to the circuit board 100. The posts 606 slightly project out from the side walls 603, 604 and thus define a slot 612 therebetween and slots 613, 614 respectively ahead of and behind the posts 606.

Figure 11:
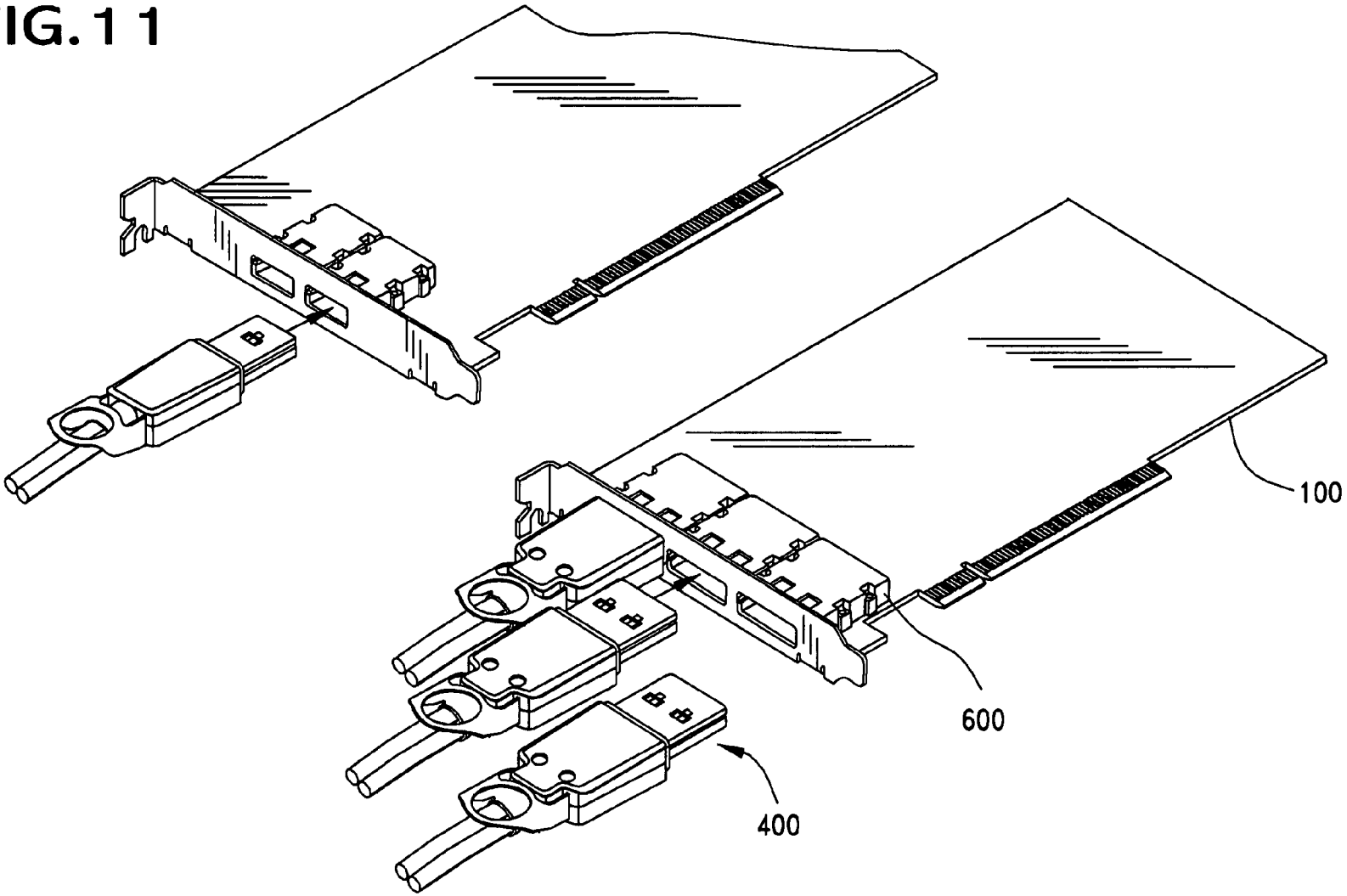
FIG. 11 is a perspective view illustrating a side-by-side arrangement of the shielded housings of FIG. 10.

The posts 606 on each of the sidewalls 603, 604 are staggered in their locations, meaning so that two such housings may be placed closely together on a circuit board 100 as shown in FIG. 11. In this regard, the posts 606 on the right side wall 604 will fit in the grooves 612-614 on the left side wall 604 of the shielded housing 600. In order to accommodate an even closer spacing, the grooves 612-614 are preferably recessed, meaning that the cover portion 602 includes top edges 620 that extend slightly out to the side to create a space thereunder into which the outer sides 621 of the posts 606 may fit. This is shown generally in FIG. 11. The housing 600 includes guide rails formed on the interior surfaces of its two side walls in the same manner as described above.

The housing 600 has, on its side walls 603, 604, projections in the form of rails 310 that project for preferably the entire depth of the housing 600. These rails 310 extend inwardly into the hollow interior space of the housing 600 and serve to guide the plug connector mating portion into mating engagement with the contact portions of the connectors. As illustrated, these rails have front end portions 625 that extend out from the face of the housing 600. This assists in locating the housing for blind mate connection with the opposing mating plug connector 400. This structure is better shown in the enlarged detail view of FIG. 10A, where it can be seen that the front end portion 625 projects forward of the front edges of the housing 600. This facilitates the blind mating capability of the invention in that a user can feel, by touch, where the opening is and where the side wall guide members are located.

FIG. 10 further shows a modification of the present invention in that the housing 600 not only are two guide members 310 formed on the side walls 603, 604 but also a third guide member 626 that is formed on the top wall of the housing 600, specifically in the cover member top portion 602. This third guide member 626 is illustrated as a ridge 627 that is stamped and formed in the cover and which extends downwardly into the hollow interior portion of the housing 600. In instances where the cover member may be die cast, as is shown in FIG. 10B, the vertical guide member 311 may be formed as part of the cover portion 602. As illustrated, the three guide members 310, 311 may be considered to lie at the apexes of an imaginary triangle "TR" shown by the phantom lines in FIG. 10B. The gidue rails 310 and their front end portions 625 serve to provide a blind mating aspect to the housing, while the third projection 627 serves as a keying aspect to ensure that the plug connector is not inserted into the housing 600 upside down. These three points of engagement lie in two distinct planes, namely the two horizontal projections 310 and the one vertical projection 627.

Figure 12:
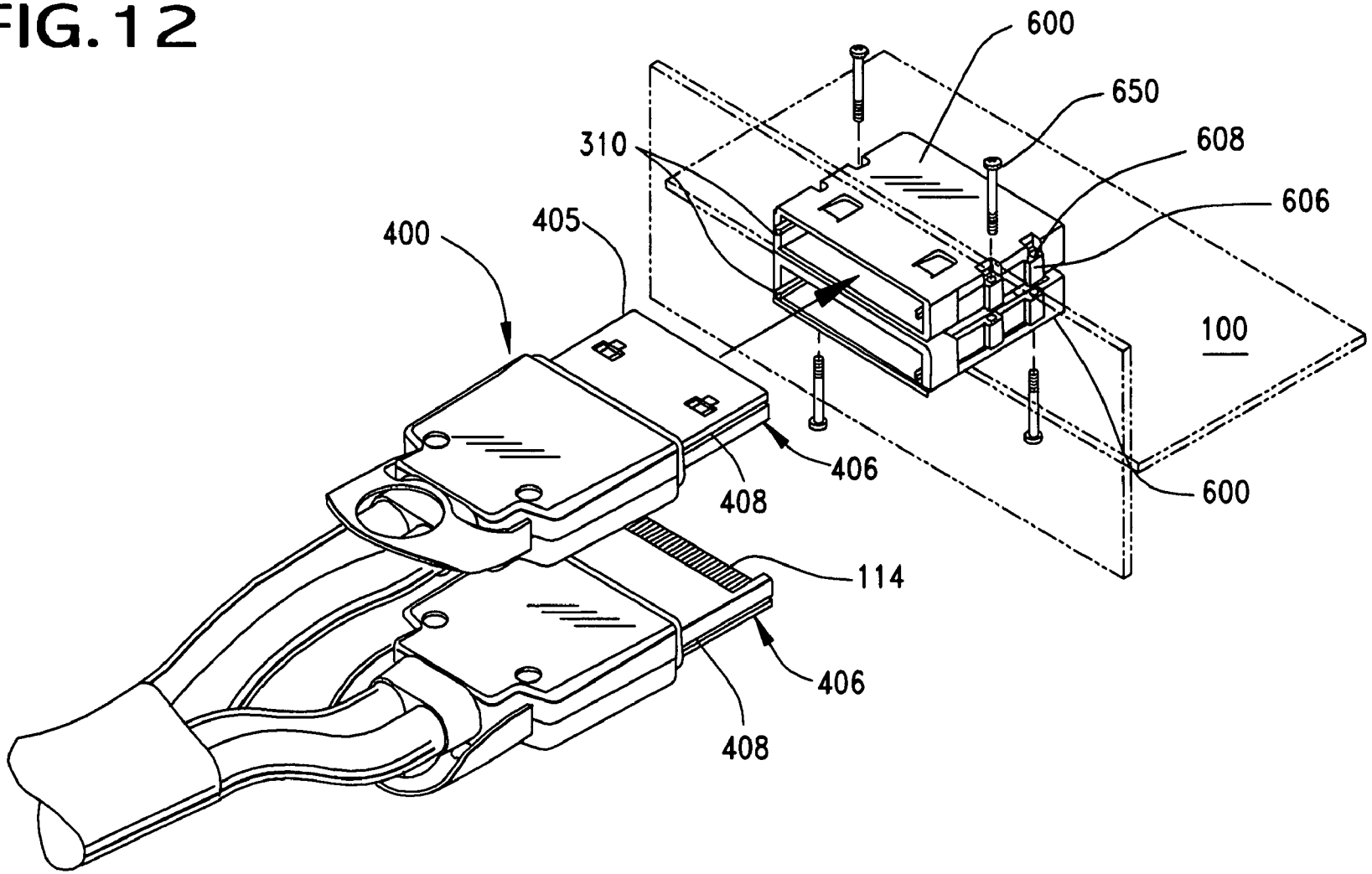
FIG. 12 is a perspective view of two of the housings of FIG. 10 arranged in a belly-to-belly arrangement on opposite sides of a circuit board; and, FIG. 13 is a perspective view of another embodiment of a housing constructed in accordance with the principles of the present invention.

FIG. 12 illustrates two housings 600 of the invention arranged on opposite sides of a circuit board, which is commonly referred to in the art as a "belly-to-belly" arrangement. In this instance, the mounting screws 650 extend through the holes 608 in one set of mounting posts 606 for one housing 600 and into holes in the other set of mounting posts for the other housing. In other words, the post portions 606 will align with each other when arranged in a belly to belly arrangement. It will be understood that the housings of the invention can be made taller in height and may use pairs of projections on the interior surfaces of their sidewalls ib certain application, such as a stacked connector that is mounted to the board.

Figure 13:
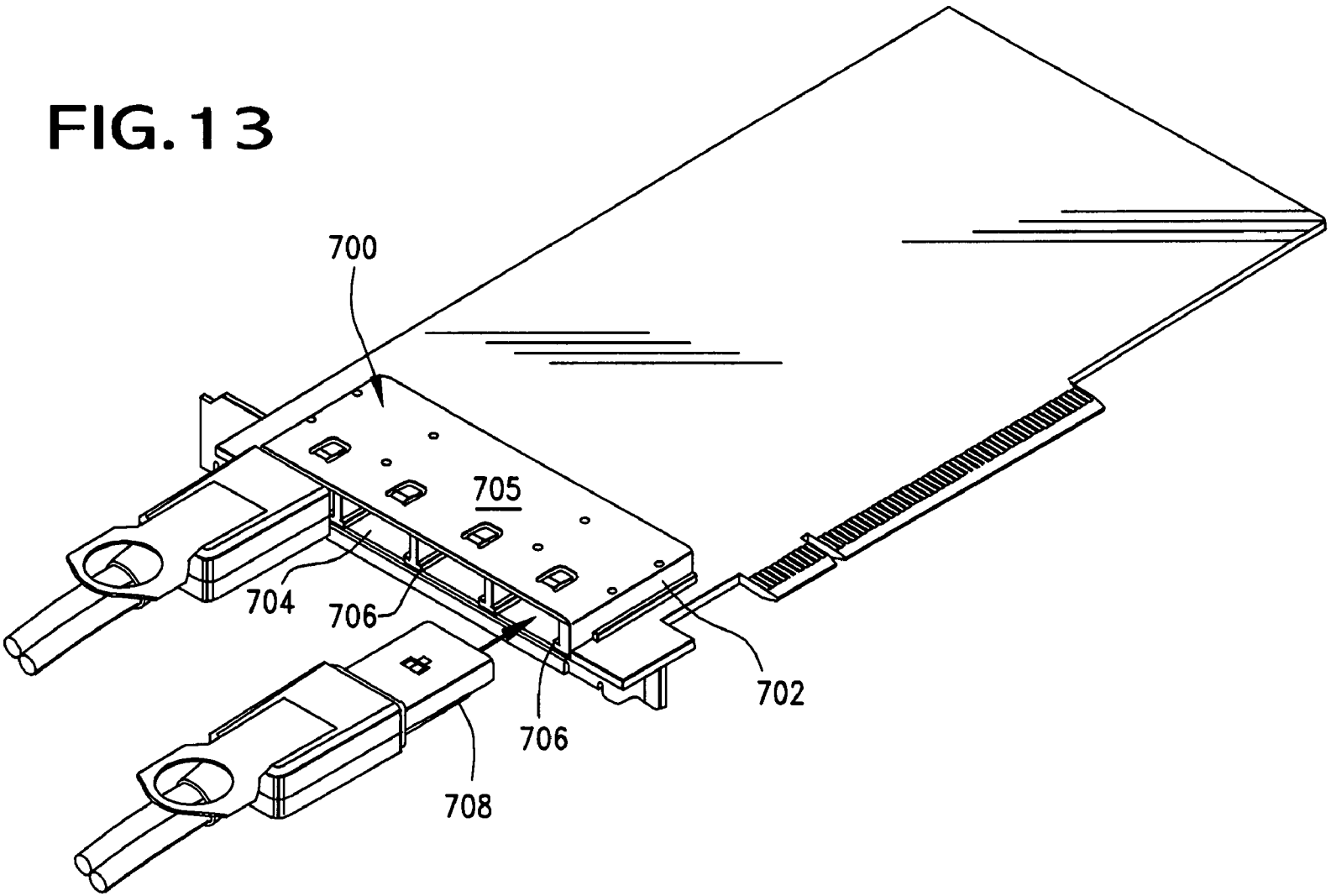

FIG. 13 illustrates another embodiment of a housing 700 constructed in accordance with the principles of the present invention. In this embodiment, a large, multiple bay base portion 702 is provided that defines multiple element-receiving bays 704, with four such bays being illustrated. The bays are enclosed by means of a conductive cover portion 705 that extends width-wise between the end walls of the base 702. The bays 704 of this housing 700 have rails or similar projections 706 formed at the intersection of their side walls and bottom walls and which extend into the hollow interior portions of the bays 704. These projections 706 fit into notches 708 that are formed on the bottom surface of the plug connector. In such a construction, there is no need to utilize a third guide member for the bottom two guide members serve both the blind mate and key functions.

While the preferred embodiment of the invention have been shown and described, it will be apparent to those skilled in the art that changes and modifications may be made therein without departing from the spirit of the invention, the scope of which is defined by the appended claims.

We claim:

1. A shielded housing for housing a connector that provides a connection between a circuit board and an opposing electronic element, the connector having a receptacle that receives a male portion from an opposing mating electronic element, comprising:

an conductive body having a plurality of walls that cooperatively define a hollow interior portion of the body, the walls further cooperatively defining an opening along a front face of the housing, the housing being at least partially formed of sheet metal and including at least a first guide member in the form of a guide tab bent from a sheet metal portion of a first one of the housing walls, the guide tab extending into the opening, the guide tab providing means for engaging and guiding the opposing electronic element into hollow interior and into engagement with said connector; and, said housing further including second and third guide members disposed along said housing opening on housing walls other than said first housing wall.

2. The housing of claim 1, wherein said first guide member is disposed on a top wall of said housing opening.

3. The housing of claim 1, wherein said second and third guide members are disposed on opposing side edges of said housing opening.

4. The housing of claim 1, wherein said housing opening includes at least three distinct sides and said first, second and third guide members are respectively disposed on each of said three distinct sides.

5. The housing of claim 1, wherein said first, second and third guide members are arranged at apexes of an imaginary triangle.

6. The housing of claim 3, wherein said second and third guide members have front end portions that extend forwardly of said housing opening.

7. The housing of claim 1, wherein said housing body includes projections along exterior surfaces of its sidewalls, the projections on one of said sidewall surfaces being staggered with respect to said projections on the other of said sidewall surfaces.

8. The housing of claim 1, wherein said housing includes a formed body portion and a sheet metal cover portion, and said guide tab is bent from said the sheet metal cover portion.

9. A shielded housing for housing a connector that provides a connection between a circuit board and an opposing electronic element, the connector having a receptacle that receives a male portion from an opposing mating electronic element, comprising:

an conductive body having a plurality of walls that cooperatively define a hollow interior portion of the body, the walls further cooperatively defining an opening along a front face of the housing, the housing being at least partially formed of sheet metal and including at least a first guide member in the form of a guide tab bent from a sheet metal portion of a first one of the housing walls, the guide tab extending into the opening, the guide tab providing means for engaging and guiding the opposing electronic element into hollow interior and into engagement with said connector; and, said housing further including second and third guide members disposed along said housing opening on side walls of said housing, and said second and third guide members having front end portions that extend forwardly of said housing opening.

* * * * *